US007014156B2

(12) United States Patent
Apezetxea et al.

(10) Patent No.: US 7,014,156 B2
(45) Date of Patent: Mar. 21, 2006

(54) CAM DEVICE FOR CLIMBING

(76) Inventors: Mikel Apezetxea, 11 Florida, 20120 Hernani (ES); Iñaki Xabier Zabala, 50 Kardaberaz-Eskubi, 20120 Hernani (ES)

( * ) Notice: Subject to any disclaimer, the term of this patent is extended or adjusted under 35 U.S.C. 154(b) by 165 days.

(21) Appl. No.: 10/183,986

(22) Filed: Jun. 28, 2002

(65) Prior Publication Data

US 2003/0019321 A1 Jan. 30, 2003

(30) Foreign Application Priority Data

Jun. 28, 2001 (ES) ..... 200101577

(51) Int. Cl.
*A47F 5/08* (2006.01)

(52) U.S. Cl. ..... 248/231.9; 248/925

(58) Field of Classification Search ..... 248/925, 248/231.9

See application file for complete search history.

(56) References Cited

U.S. PATENT DOCUMENTS 4,184,657 A 1/1980 Jardine
4,565,342 A 1/1986 Grow
4,645,149 A * 2/1987 Lowe ..... 248/231.9
4,781,346 A * 11/1988 Banner ..... 248/231.9
4,832,289 A * 5/1989 Waggoner ..... 248/231.9
5,860,629 A * 1/1999 Reed ..... 248/231.9
6,042,069 A 3/2000 Christianson
6,375,139 B1 * 4/2002 Murray et al. ..... 248/231.9

FOREIGN PATENT DOCUMENTS

AT 398167 10/1994

* cited by examiner

*Primary Examiner*—Korie Chan
(74) *Attorney, Agent, or Firm*—Browdy and Neimark, PLLC

(57) ABSTRACT

A device, which, when used in climbing, acts as an anchor in cracks with two parallel sides. The device consists of several opposing cams that rotate on the same shaft. The force generated when a climber falls is counteracted by the force of the friction between the cams and the rock. As opposed to other known spring loaded camming devices, the load generated by a fall acts on the cams, and not on the shaft, through cables that pull on the cams on the side of the shaft opposite the edge that is in contact with the wall, and which are supported on convex surfaces formed by the cams themselves.

14 Claims, 4 Drawing Sheets

CAM DEVICE FOR CLIMBING

A cam device is provided that is to be used when climbing and that acts as a solid anchor in cracks. There are currently a number of devices known as 'spring loaded camming devices' that use a cam system to perform a similar function.

BACKGROUND TO THE INVENTION

U.S. Pat. No. 4,184,657 discloses a spring-operated cam device that operates by converting a traction force moving out of the crack into a force moving in against the wall faces of the crack through the use of cams. The friction created between the cams and the crack walls counteracts the force pulling on the device.

In general, this device consist of four cams mounted on a single shaft about which the cams can rotate, the shaft being connected to a support bar or a rod that is used to pull on the cams. The four cams are exactly the same but the two cams located at the ends of the shaft point out to one side of the shaft whereas the other two point out to the other side.

The edge of the cams that make contact with the wall forms a log spiral, the axis of which lies in the shaft. The radius of the log spiral increases gradually between two sizes, in accordance with the constant angle of the spiral. The device can thus be used in cracks sized between a minimum and maximum size limit (being this range of sizes usually referred to as "expansion range"). The edge of the cam must form a log spiral so that the limit of the coefficient of friction that enables the device to secure itself is the same in cracks of different widths into which it is inserted. The expansion range of the device can be increased with a greater constant angle of the spiral but this also increases the limit of the coefficient of friction by which the device operates, thus reducing the device's ability to secure itself.

Springs are used to extend the cams fully. The device is inserted into a crack by pulling on a trigger or an operating rod attached to cables that gather together the cams, with the end of the support bar acting as a pressing point for the user's palm of the hand when pulling the trigger and as the support point for the climbing rope. The device is then inserted into the crack and the operating rod is released. All the cams are then urged outwardly by the springs and secure themselves in position against the sides of the crack.

Patent AT-B-398.167B describes a device in which the outwardly directed load applied on the device is applied by cables. This load is exerted not on the shaft but on the cams on the side of the shaft opposite the edge that makes contact with the wall. As a result, if the cable is pulled, the cams tend to rotate towards a position in which they are extended further. Each cable is connected to each cam by a articulated link, where the articulated link is located at an eccentric position relative to the common pivot axis of the cams.

The momentum of the shaft exerted on the cam when force is applied at a distance from the shaft (i.e., at an eccentric position relative to the common pivot axis) and not directly on it can increase the range (or diameter) of the spiral or, if the range remains the same, can increase the device's ability to secure itself. However, in the different rotational positions of the cams, the distance from the shaft (the pivot axis of the cam) to the side of the crack (the point of contact between the cam and the wall of the crack) and to the vector (moment) of the force applied by the cable do not remain proportional to each other. This means that the device's ability to secure itself varies according to the different rotational positions of the cams. As for the distribution of the loads on the cams, although the loads can be distributed evenly on the cams pointing to one side and the cams pointing to the other, it is not possible to distribute the loads evenly on the two cams on one side when these are in different rotational positions. Furthermore, as the body of the device is formed by the cables that pull on the cams, these cables must be sufficiently rigid in order to take the load off the device.

It is an object of this invention to provide a cam device especially for use in climbing and which functions equally well in all the possible rotational positions of the cams.

Another object of this invention is to create a cam device wherein the force exerted on the device is distributed evenly between the cams, even when they are all in different rotational positions.

SUMMARY OF THE INVENTION

In order to achieve these objectives, the device that is the object of this invention consists of a number of opposing cams that can rotate on the same shaft. Cables, or loading members, attached to the cams apply the outwardly directed load on the device. The main innovation of the device is the way in which the cables act on the cams.

The cables should be as flexible as possible. Each end of the cable is secured to a cam and exerts the load on the cam on the side of the shaft opposite the edge that makes contact with the wall. The cable is supported on a convex surface formed by the body of the cam itself.

To ensure that all the possible rotational positions of the cams function equally well, the convex surface where the cables are supported form a log spiral with a range (or diameter) and axis equal to the log spiral formed at the edge of the cam that is in contact with the wall. The log spiral of the convex surface unwinds in the same direction as the other log spiral formed at the edge of the cams.

As part of this system, for each cam, the distance from the shaft (pivot axis of the cams) to the side of the crack (point of contact between the cam and the wall of the crack) and the distance from the shaft to the vector (moment) of the force exerted on the cable, regardless of the rotational position of the cams, are, ideally, proportional to each other.

The end of the components (the cables) that apply the load to the cams is attached to each cam in each pair of opposing cams. By pulling on the middle section of this component, the pair of cams is also pulled. In a device with two pairs of cams, the two cables are pulled by a unit consisting of two intermediate slings with two eye terminals or grommets on either end, linked together by a belt. One of the cables that pulls on the cams is passed through each terminal on the free ends of the slings, which are connected by a rigid unit called a distributor. By pulling on the belt, the force applied on the device is distributed evenly between the four cams even when one of them is in a different rotational position. The distributor tilts when two opposing cams are in a more extended rotational position than the other two cams.

The body of the device consists of a flexible rod connected to the shaft at a midpoint of the shaft. The rod, together with a trigger connected to all of the cams forms a unit by which the cams are retracted ("closed" position) when the device is removed from or inserted into a crack.

The cams are rotated to a position in which they are fully extended (in their "open" position) by a spring that exerts pressure on the cables applying the load on the cams. This spring, which is disposed on and guided by the rod at the same time, acts when the shaft and distributor are compressed. When the trigger is pulled, the intermediate slings and distributor are moved, pulled towards the shaft by the cables pulling on the cams, thus compressing the spring. The spring acts on a catch on the distributor. When the distributor tilts, the catch turns and is held on the same plane, ensuring that the spring continues to operate effectively.

A BRIEF DESCRIPTION OF THE FIGURES

DESCRIPTION OF A PREFERRED METHOD OF MAKING THE DEVICE

Figure 1:
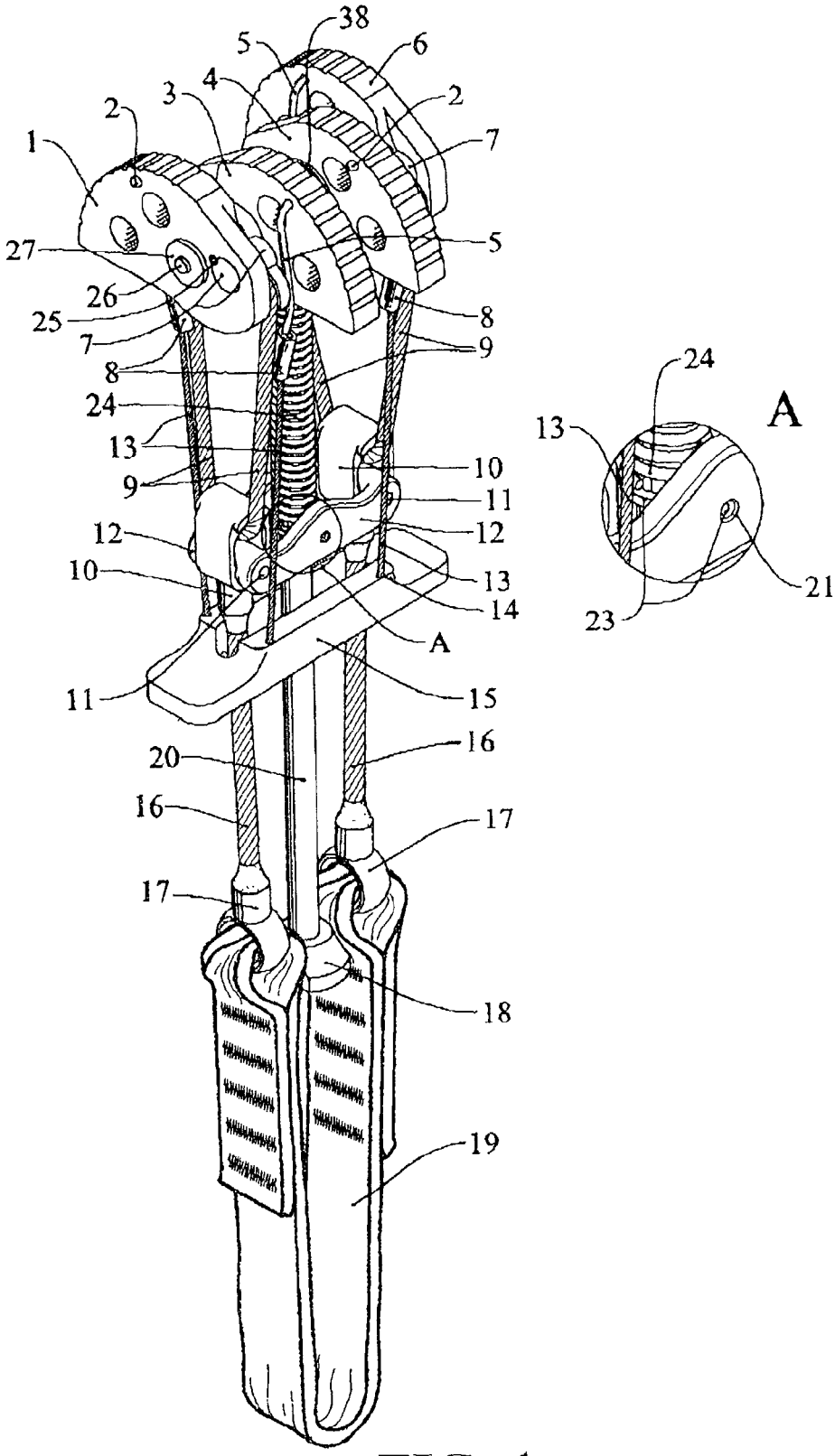
FIG. 1 is a view of the device with the cams in a fully extended position.
Figure 2:
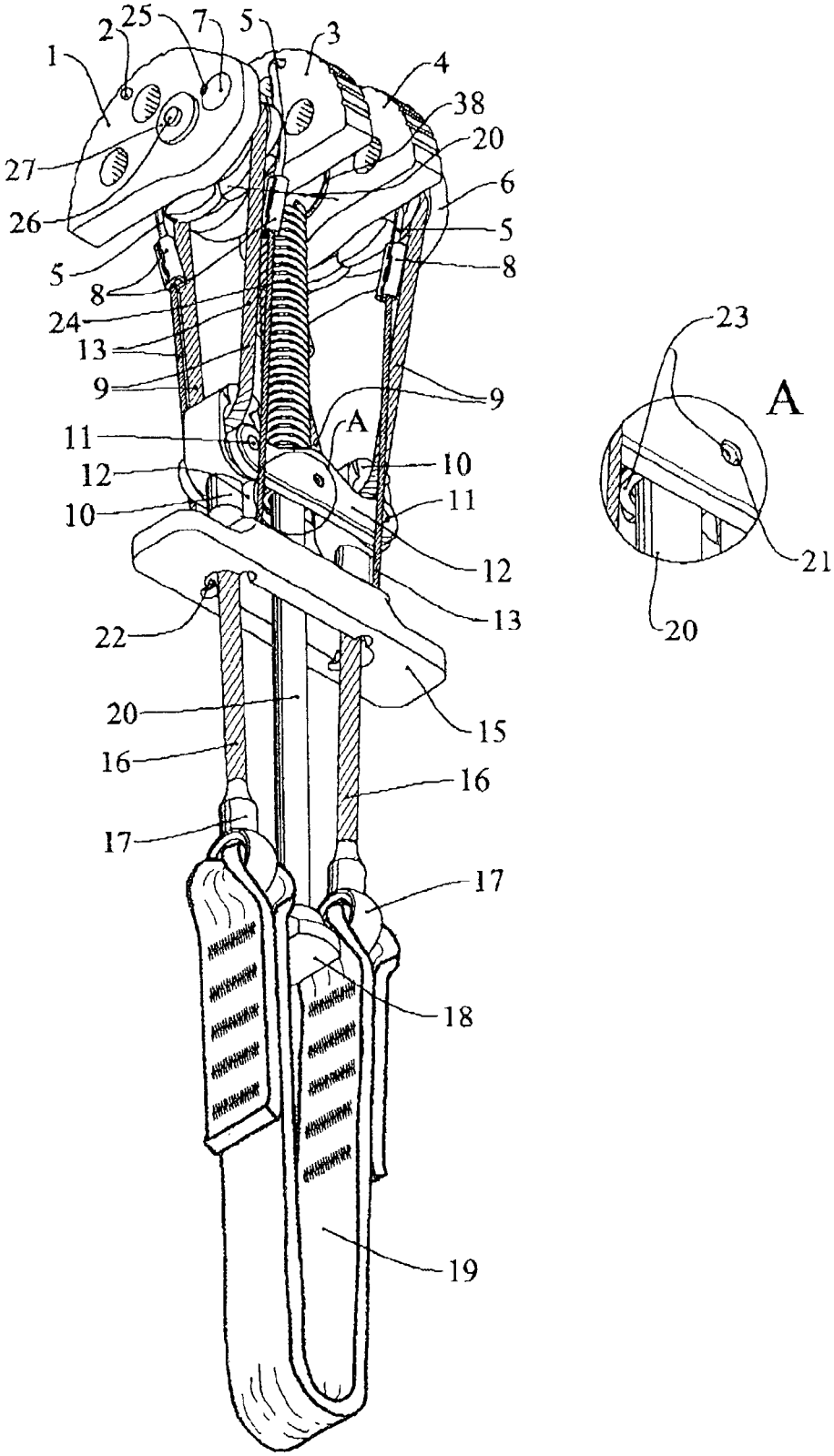
FIG. 2 is another view of the device with the cams in a fully extended position.
Figure 3:
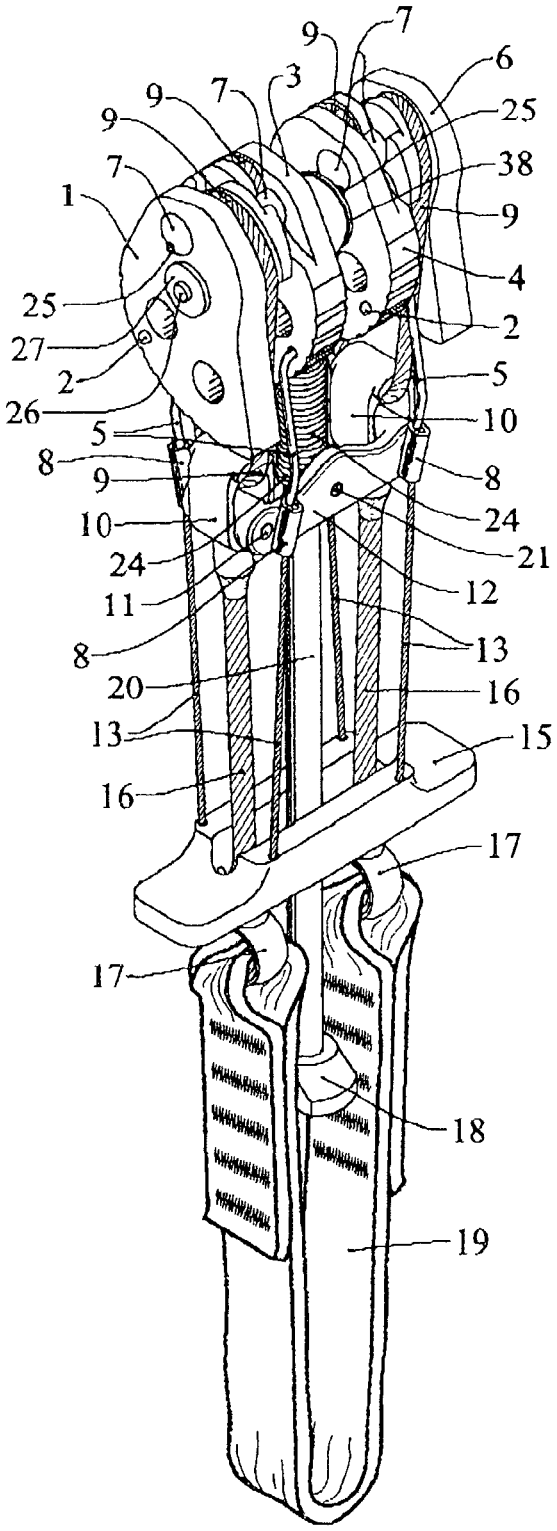
FIG. 3 is a another view of the device with the cams in a fully retracted position.
Figure 4:
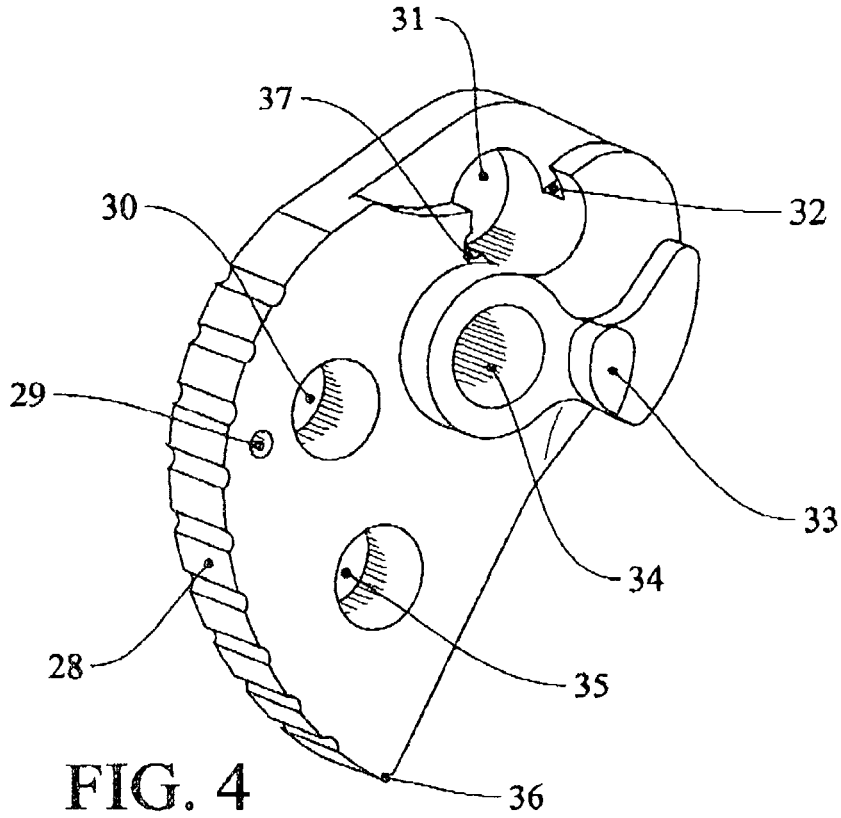
FIG. 4 is a view of one of the cams of the device.
Figure 5:
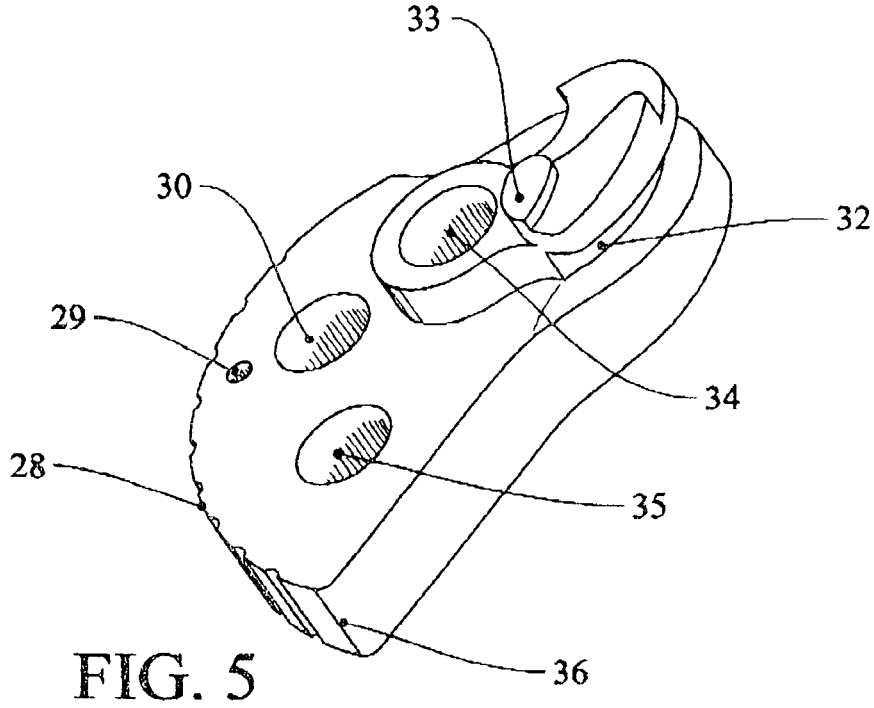
FIG. 5 is a another view of one of the cams of the device.

FIGS. 4 and 5 are both diagrams of a cam, e.g., one of the cams (1, 3, 4, 6) in FIGS. 1, 2, and 3. These figures show the log spiral that forms the spirally shaped edge (28) of the cams that is in contact with the wall and the log spiral that forms the interior convex surface (32) of the groove in which the cable (9) is supported when it pulls on the cam. The shaft (26) on which the cam rotates is introduced in the hole (34) of the cam. The other holes (30) and (35) serve to reduce the weight of the cams. The catch or stop (33) prevents the cams from rotating beyond the position in which they are fully extended (the "open" position). As can be seen in FIGS. 1, 2 and 3 the cams (1) and (3) are the same and cams (4) and (6) are symmetrical to cams (1) and (3).

The cables (9) are as flexible as possible. Cylindrical terminals (7) with a groove have been injected onto the end of the cables. To secure the cable to the respective cam, the terminal (7) is fitted into the hole (31) in the cam and is then rotated until the cable rests on the interior surface (32) of the groove 37 of the cam. To immobilise the terminal, a clamping sleeve (25) is then inserted into the recess formed between the groove on the terminal (7) and the groove (37) on the cam. This prevents the terminal (7) from working loose from the cam. Before the two terminals (7) are secured on the two cams in an opposing pair of cams, one of the terminals must be fed through the terminal (10) on the intermediate slings (16) that pull on the cables (9).

These intermediate slings (16) are made with cables that are as flexible as possible and welded or pressed eye terminals (10, 17). The terminal (10) through which the cable (9) passes must have an eyelet that is large enough and shaped in such a way that the cable terminal (7) can be inserted into the terminal (10) and the distributor (12) housed in it, with the distributor having enough space to tilt. Furthermore, the area where the cable (9) and the terminal (10) come into contact with each other should be sufficiently curved so that the cable is not damaged. The lower eye terminal (17) must have an eyelet that is large enough to allow the final swing or belt (19) to be inserted into the terminal (17) and must not have rough edges, as these may damage the belt. The ends of the belt (19) are sewn together once it has been fed through the respective terminals (17).

The distributor unit (12) is made up of two metal parts, which, once they have been fitted into the terminals (10), one on either side, are riveted together by securing pins (11). The length of the distributor (12) establishes the gap separating the terminals (10) which, along with the gap between the two pair of cams, must be wide enough to ensure, first of all, that the cables (9) do not touch the edges (36) of the cams when the cams are retracted fully and that the distributor (12) tilts sufficiently, between 45° and 60° approximately, when one of the pairs of cams is fully retracted and the other pair is fully extended. The distributor parts (12) each have holes (21) in their mid sections. These distributor parts act as supports for the catch or stop (23), which is mounted between the distributor parts (12) and can rotate with respect to them. Rod (20 passes through catch (23). Catch (23) acts as a stop for the spring (24). The catch (23) must be fitted into the position at the same time as the metal distributor parts (12) are inserted into the terminals (10) so that it cannot work loose once they have been riveted.

The rod (20) is made of a light, elastic material and is capable of withstanding, without bending, the force of compression that acts on the rod when the trigger (15) is pulled. The support point (18) is a separate piece that is stuck with adhesive to the rod after the rod has been inserted into the spring (24) and the catch (23).

A trigger (15), with a large enough space inside the trigger (15) to allow both the rod (20) and, when the unit is being assembled, the lower terminals (17) to pass through, is used to retract the cams (1, 3, 4, 6). The trigger (15) is connected to each of the cams by cables (13) and auxiliary wires (5) so that when the trigger (15) is pulled, a force is exerted on the cams on the same side of the shaft (26) as the edge (25) that is in contact with the wall. The cables (13) are fastened to the trigger (15) by pressing a terminal (22) on one end after the cable has been introduced through the hole in the trigger (15). The cables (13) are connected to the auxiliary wires (5) with pressed copper sleeves (8) and the auxiliary wires (5) are attached to the cams by bending them to form heads at the tips (2) after they have been inserted into the holes (29) in the cams. In each cam, the distance from the shaft (pivot axis of the cams) to the side of the crack (point of contact between the cam and the wall of the crack) and the distance from the shaft to the vector (moment) of the force exerted on the cable, regardless of the rotational position of the cams, are, ideally, proportional to each other.

The opposing pairs of cams formed by pairs (1) and (3) and (4) and (6) are mounted on the shaft as well as the rod (20) which is positioned between cams (3) and (4) and is separated from them by internal washers (28). Once the unit has been assembled, a washer (27) is positioned on both ends of the shaft (26), both of which have been machined with a smaller diameter than the rest. The end of the shaft is then riveted over the washer.

The invention claimed is:

1. A cam device of the type that engage cracks having two facing walls for use during climbing, said cam device comprising a shaft;

a plurality of cams disposed on the shaft to rotate about the shaft, each of the cams having an edge to contact the crack walls that is disposed on one side portion of said cam and a convex surface disposed on another side portion of said cam opposite said edge of said cam in contact with the walls;

a component for applying a load on two adjacent ones of said plurality of cams, said component is wrapped on said convex surface to exert a load on the cam on said another side portion of the cam opposite said edge of the cam that is in contact with the walls;

a sling having eye terminal on both ends where said one eye terminal is connected to said component for applying the load on the cams;

said component having ends and each of said end is fastened to a respective one of said adjacent cams such that when the component is pulled, the adjacent cams are rotated simultaneously about said shaft;

and a spring operatively exerting pressure on the component and rotating the cams to a position in which the cams are fully extended.

2. A cam device according to claim 1, wherein the component for applying the load on the cams is a steel cable.

3. A cam device according to claim 2, further comprising a rigid unit, connecting the eye terminal on the sling, through which the component for applying the load on the cams passes.

4. A cam device according to claim 3, further comprising a rod passing through the rigid unit and connected to the shaft, the spring being disposed on the rod, wherein the spring acts to bias the cams to the fully extended position when the rigid unit and the shaft are compressed toward one other.

5. A cam device according to claim 1, further comprising a rigid unit, connecting the eye terminal on the sling, through which the component for applying the load on the cams passes.

6. A cam device according to claim 5, further comprising a rod passing through the rigid unit and connected to the shaft, the spring being disposed on the rod, wherein the spring acts to bias the cams to the fully extended position when the rigid unit and the shaft are compressed toward one other.

7. A cam device of the type that engage cracks having two facing walls for use during climbing, comprising:

a shaft;

opposing cam members pivotally mounted on the shaft about a common pivot axis, each of the cam members having an edge to contact a crack wall, where the contact between the edge and the crack wall takes place substantially at a determined point of contact on said edge, said point of contact varying according to the rotational position of the cam member;

loading members having ends fastened to the cam members and applying a load on each cam member in an eccentric position relative to the common pivot axis of the cam members and on the side of said axis remote from the point of contact between the edge of each cam member and the crack wall;

intermediate slings that pull on the loading members;

a final belt that pulls on the intermediate slings;

a spring which urges each cam member toward a fully extended position;

a rod mounted on the shaft;

a trigger connected to the cams so as to urge the cam members toward a retracted position, wherein in at least one cam member, the loading member is supported on a convex surface formed on that cam member, so that a last point of contact between the convex surface and the loading member varies according to the rotational position of the cam member; and the ends of the loading members are fastened to opposing cam members; and the spring applies a downward force on the loading members.

8. The cam device of claim 7, wherein the convex surface is shaped so that the quotient of a first distance and a second distance remains constant for all degrees of opening of the cam member, where the first distance is a distance from the last point of contact between the convex surface and the loading member to the common pivot axis of the cam members, and the second distance is a distance from the common pivot axis to the point of contact between the edge of the cam member and the crack wall.

9. The cam device of claim 7, wherein the loading member is a flexible wire rope.

10. The cam device of claim 7, wherein the intermediate slings are provided with eye terminals at both ends.

11. The cam device of claim 10, wherein the terminals ends of the intermediate slings where the intermediate slings pull on the loading members are connected together by a rigid member.

12. The cam device of claim 11, wherein the spring operates by compression between the rigid member and the shaft, and the rod passes through the inside of the spring.

13. A cam device according to claim 10, further comprising a rigid unit, connecting the eye terminals on the slings, through which the loading members for applying the load on the cams passes.

14. A cam device according to claim 13, further comprising a rod passing through the rigid unit and connected to the shaft, the spring being disposed on the rod, wherein the spring acts to bias the cams to the fully extended position when the rigid unit and the shaft are compressed toward one other.

* * * * *